US009021954B2

(12) United States Patent
Morris et al.

(10) Patent No.: US 9,021,954 B2
(45) Date of Patent: May 5, 2015

(54) REACTIVE CONDUCTORS FOR INCREASED EFFICIENCY OF EXPLODING FOIL INITIATORS AND OTHER DETONATORS

(71) Applicant: U.S. Army Research Laboratory, Adelphi, MD (US)

(72) Inventors: Christopher J. Morris, Silver Spring, MD (US); Paul Wilkins, Oakland, CA (US); Chadd May, Livermore, CA (US); Eugene Zakar, Bethesda, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/685,884

(22) Filed: Nov. 27, 2012

(65) Prior Publication Data

US 2013/0133542 A1 May 30, 2013

Related U.S. Application Data

(60) Provisional application No. 61/564,463, filed on Nov. 29, 2011.

(51) Int. Cl.

| | |
|---|---|
| ***F42B 3/12*** | (2006.01) |
| ***F42B 3/13*** | (2006.01) |
| ***F42B 3/18*** | (2006.01) |

(52) U.S. Cl.
CPC ... *F42B 3/12* (2013.01); *F42B 3/18* (2013.01); *F42B 3/124* (2013.01)

(58) Field of Classification Search
USPC ..... 102/200, 202, 202.5, 202.6, 202.7, 102/202.8, 202.9, 202.11; 149/5, 15, 33, 149/37, 109.2
See application file for complete search history.

(56) References Cited

U.S. PATENT DOCUMENTS

| | | | | |
|---|---|---|---|---|
| 4,464,989 | A * | 8/1984 | Gibson et al. | 102/202 |
| 4,602,565 | A | 7/1986 | MacDonald et al. | |
| 5,080,016 | A | 1/1992 | Osher | |
| 5,912,427 | A | 6/1999 | Willis et al. | |

(Continued)

OTHER PUBLICATIONS

Morris, C. J., Currano, Luke, and Zakar, E., "Nanoenergetic Materials for Energy Conversion Applications," European MRS Symposium, Strassbourg, France, Jun. 8, 2009 (invited talk).

(Continued)

*Primary Examiner* — James S Bergin
(74) *Attorney, Agent, or Firm* — Alan I. Kalb; Eric B. Compton

(57) ABSTRACT

Provided among other things are reactive energetic material systems used for conductors in detonators for increased efficiencies. According to an embodiment, a detonator may include: a conductor including at least two constituents including (i) an electrically conductive constituent, and (ii) an electrically non-conductive constituent, that when subjected to sufficient electrical energy, result in an exothermic reaction; and a flyer plate having a non-conductive surface in contact with said conductor. When the sufficient electrical energy is supplied to said conductor, rapid heating and vaporization of at least a portion of the conductor occurs so as to explosively drive at least a portion of the flyer plate away from said conductor. In an embodiment, a multilayer conductor may be formed of alternating layers of at least one electrically conductive layer, and at least one electrically non-conductive layer, that when subjected to sufficient electrical energy, result in an exothermic reaction.

22 Claims, 6 Drawing Sheets

(56) References Cited

U.S. PATENT DOCUMENTS

| | | | | |
|---|---|---|---|---|
| 6,327,978 | B1 | 12/2001 | Turano et al. | |
| 6,925,938 | B2 * | 8/2005 | Baginski et al. | 102/202.7 |
| 7,363,860 | B2 * | 4/2008 | Wilson et al. | 102/205 |
| 7,951,247 | B2 * | 5/2011 | Barbee et al. | 149/15 |
| 8,298,358 | B1 * | 10/2012 | Coffey et al. | 149/2 |
| 8,511,229 | B2 * | 8/2013 | Desai et al. | 102/202.5 |
| 2009/0178741 | A1 * | 7/2009 | Xun et al. | 149/15 |
| 2013/0008334 | A1 * | 1/2013 | Claridge et al. | 102/202.5 |

OTHER PUBLICATIONS

Morris, C. J., Mary, B., Zakar, E., Barron, S., Fritz, G., Knio, O., Weihs, T. P., Hodgin, R., Wilkins, P., and May, C., "Rapid Irritiation of Reactions in AlINi Multilayers with Nanoscale Layering," J Phys Chern Solids, vol. 71, No. 2, pp. 84-89 (2010).

C. J. J Morris, P. Zakar, Eugene Wilkins, C. May, and T. P. Weihs, "Streak spectroscopy of reactive Al/Ni foil initiators," in Proc. 27th Annual Army Science Conference, (Orlando, FL), Nov. 30-Dec. 3, 2010.

A. J. Gavens, D. V. Heerden, A. B. MallD, M. E. Reiss, and T. P. Weihs, "Effect of intermixing on self-propagating exothermic reactions in Al/Ni nanolaminate foils," Journal of Applied Physics, vol. 87, No. 3, pp. 1255-1263, 2000.

A. J. Swiston, T. C. Hufnagel, and T. P. Weihs, "Joining bulk metallic glass using reactive multilayer foils," Scripta Materialia, vol. 48, No. 12, pp. 1575-1580, 2003.

R. C. Wiengart, R. S. Lee, R. K. Jackson, and N. L. Parker, "Acceleration of thin flyers by exploding metal foils: applications to initiation studies," in Proc. 6th Symposium on Detonation, p. 653, 1976.

K. J. Blobaum, M. E. Reiss, J. M. Plitzko, and T. P. Weihs, "Deposition and characterization of a self-propagating CuO—x/Al thermite reaction in a multilayer foil geometry," Journal of Applied Physics, vol. 94, No. 5, p. 2915, 2003.

K.1. Blobaum, A. J. Wagner, J. M. Plitzko, D. V. Heerden, D. H. Fairbrother, and T. P. Weihs, "Investigating the reaction path and growth kinetics in CuO—x/Al multilayer foils," Journal of Applied Physics, vol. 94, No. 5, p. 2923, 2003.

E. Zakar, M. Dubey, B. Piekarski, 1. Conrad, R. Piekarz, and R. Widuta, "Process and fabrication of a lead zirconate titanate thin film pressure sensor," Journal of Vacuum Science & Technology A, vol. 19, No. 1, pp. 345-348, 2001.

J. Wang, E. Besnoin, O. M. Knio, and T. P. Weihs, "Effects of physical properties of components on reactive nanolayer joining," Journal of Applied Physics, vol. 97, No. 11, p. 114307, 2005.

S. H. Fischer and M. C. Grubelich, "Theoretical energy release of thermites, intermetallics, combustible metals," in Proc. 24th Int. Pyrotechnics Seminar, (Monterey, CA), pp. 1-4, Jul. 1998.

* cited by examiner

REACTIVE CONDUCTORS FOR INCREASED EFFICIENCY OF EXPLODING FOIL INITIATORS AND OTHER DETONATORS

CROSS REFERENCE TO RELATED APPLICATION

This application claims the benefit of U.S. Provisional Patent Application No. 61/564,463 filed Nov. 29, 2011, herein incorporated by reference it its entirety.

GOVERNMENT RIGHTS

Research underlying this application was funded, in at least part, under contract number DE-AC52-07NA27344, awarded to Lawrence Livermore National Security, LLC, which manages and operates Lawrence Livermore National Laboratory. The U.S. Government has certain rights in this invention.

FIELD

This application generally concerns detonators, such as an exploding foils initiator (EFI), or a slapper detonator.

BACKGROUND

EFIs and slapper detonators are used to rapidly convert energy from an electrical power pulse through a conductor to kinetic energy of a flyer plate. They are generally considered a safe means for reliably initiating insensitive energetic materials, or secondary energetic materials, but require significant power input for operation. This input power is typically supplied over the course of a few hundred nanoseconds.

Multilayered nickel/aluminum (Ni/Al) bridges have been used in air-bag deployment. In this application, when electrical current is supplied to heat the bridge, the metal reacts, and hot, reactive particles are thrown towards a main charge, increasing the reliability of igniting that charge within several hundred microseconds.

High voltage and high current requirements typical of these devices, however, increase the cost of firing circuit components. Reducing the electrical energy required to launch the flyer plate and to initiate a secondary energetic may be useful.

SUMMARY

Provided among other things are reactive energetic material systems used for conductors in detonators for increased efficiencies. The detonators may include exploding foils initiators, or slapper detonators.

According to an embodiment, a detonator includes: a conductor including at least two constituents including (i) an electrically conductive constituent, and (ii) an electrically non-conductive constituent, that when subjected to sufficient electrical energy, result in an exothermic reaction; and a flyer plate having a non-conductive surface in contact with said conductor. When the sufficient electrical energy is supplied to said conductor, rapid heating and vaporization of at least a portion of the conductor occurs so as to explosively drive at least a portion of the flyer plate away from said conductor.

According to an embodiment, a detonator includes: a multilayer conductor formed of alternating layers of at least one electrically conductive layer, and at least one electrically non-conductive layer, that when subjected to sufficient electrical energy, result in an exothermic reaction, the alternating layers being substantially parallel with edges of the alternating layers defining a sidewall; an electrode formed on at least a portion of the sidewall that ensures electrical connectivity to each electrically conductive layer of the conductor; and an exploding plate having a non-conductive surface in contact with said conductor. When the sufficient electrical energy is supplied to said conductor, rapid heating and vaporization of at least a portion of the conductor occurs so as to explosively drive at least a portion of the plate away from said conductor.

DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments.

Figure 1A:
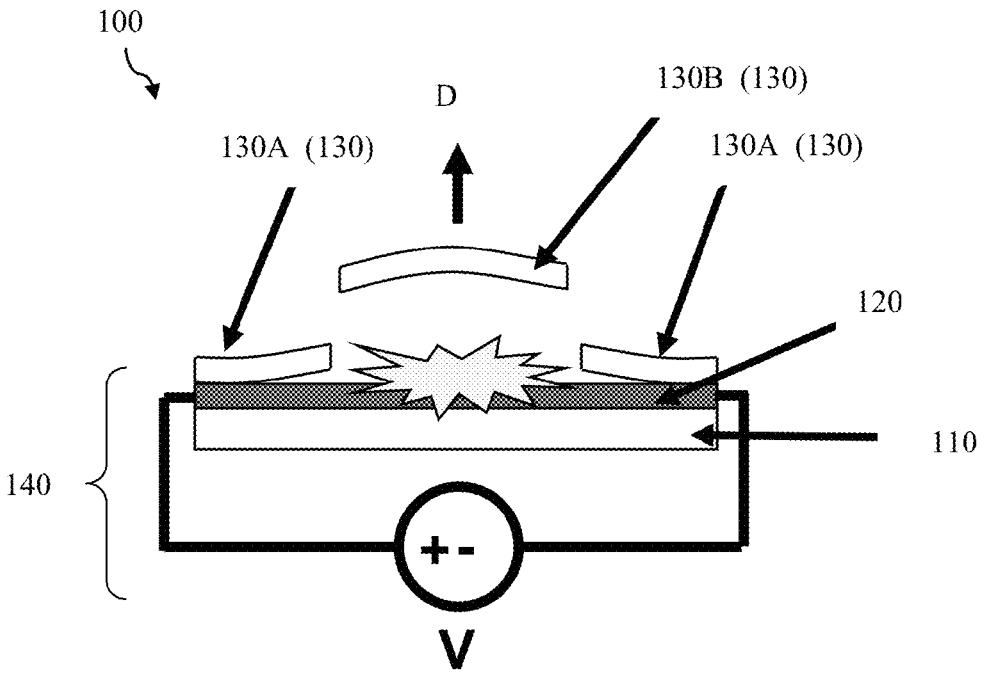
FIG. 1A shows a schematic of a detonator used to rapidly convert energy to kinetic energy of an exploding plate according to an embodiment.

To facilitate understanding, identical reference numerals have been used, where possible, to designate comparable elements that are common to the figures. The figures are not drawn to scale and may be simplified for clarity. It is contemplated that elements and features of one embodiment may be beneficially incorporated in other embodiments without further recitation.

DETAILED DESCRIPTION

In various embodiments, the use of reactive energetic material systems in the conductor advantageously increases the kinetic energy level output of a detonator. Electrically forcing a reaction to heat rapidly through Joule-heating can cause the reaction to occur much more quickly than it would normally do so under its own self-propagation rate. More particularly, when sufficient electrical energy is supplied to a fully or partially electrically conductive conductor, Joule heating causes rapid heating and vaporization of at least a portion of the conductor to occur so as to explosively drive a portion of a plate away from the conductor.

The storage of chemical energy in the reactive materials reduces the electrical energy storage requirements for an initiation event. Thus, if a certain kinetic or thermal energy threshold is required by a particular application, the necessary electrical energy required to achieve that threshold can be reduced because the remaining energy will come from the reactive conductor itself. Their use may also reduce instantaneous power requirements and enable detonators to be produced smaller, cheaper, and have a higher degree of precision and safety. And such devices may benefit from precise spatial thermal distributions, achieved through careful control of the timescales over which these reactions take place. Reduction in cost will allow slapper detonators and EFIs to be used in a wider variety of applications, such as military munitions which trigger a primary explosive charge, vehicle air-bag deployment, and welding or joining reactive layers in nano-manufacturing or other fabrication processes.

As used herein, an electrically conductive material means any material that readily conducts electricity. It may be characterized as having an electrical resistivity less than about 50 micro-Ohm-centimeters, for example. On the other hand, an electrically non-conductive material means any material that does not readily conduct electricity. It may be characterized as having an electrical resistivity which is 20 times or greater than that of an electrically conductive constituent; it may be characterized as having an electrical resistivity greater than about 1000 micro-Ohm-centimeters, for example. An electrically non-conductive material may also be thought of an electrical insulator material, including a dielectric material, for instance.

FIG. 1A shows a schematic of a detonator 100 used to rapidly convert energy to kinetic energy of an exploding plate according to an embodiment. The detonator 100 generally includes a substrate 100, a conductor 120, and a flyer layer 130.

The substrate 110 generally needs to be electrically isolating. Thus, the substrate 110 may be an electrical insulator material, such as silicon or the like, on which semiconductor devices are typically fabricated. In some instances, the substrate may formed to be about 0.5 mm or greater in thickness. Due to the explosive nature of the detonator, the substrate) 10 can be formed of a high stiffness material having a high speed of sound for favorable acoustic impedance properties.

Formed on the substrate 110 is the conductor 120. The conductor 120 may include at least two constituents that when subjected to sufficient electrical energy, result in an exothermic reaction. The exothermic reaction may be a chemical reaction, a physical reaction, or some combination thereof in which the product(s) of the reaction have a lower heat of formation than the constituent reactants. Typically, this exothermic reaction may be characterized by the release of heat into the environment, i.e., having a negative enthalpy. A physical reaction may include, for example, the constituent reactants mixing with application of electrical energy, even if there is no resultant reaction products formed. Many intermetallic material systems fall into this category. Nickel and aluminum, for example, react to form solid-state intermetallic products; however, more than 90% of the energy released from the reaction occurs when nickel and aluminum are simply mixed.

The exothermic reactions may take place at or near room temperature and atmospheric pressure due to Joule heating, but could occur at higher or lower temperatures and pressures depending on the application. Certain embodiments may not rely on gas-producing reactions, but rather rely on increasing the temperature and therefore the energy of the vaporized conductor. In some instances, the exothermic reaction may be characterized as having a large negative enthalpy (i.e., greater than about 1 kJ/g).

In some embodiments, the conductor 120 may include at least two constituents including (i) an electrically conductive constituent, and (ii) an electrically non-conductive constituent, that when subjected to sufficient electrical energy, result in an exothermic reaction. For example, the exothermic reaction may be provided by a thermite material system including a metal constituent and a metal oxide constituent. Aluminum (Al)-based or magnesium (Mg)-based thermite systems may be used in certain embodiments because energy densities available from these systems are 25-100% of the required kinetic energy. And in other embodiments, exothermic reaction may be provided by intermetallic material system including at least two metallic constituents where one is an electrically conductive metal constituent and the other is electrically non-conductive metal constituent. Some exemplary electrically non-conductive metal constituents may include boron (B), carbon (C), sulfur (S), and silicon (Si); esp. substantially pure Si, to name a few.

Exemplary thermite material systems and intermetallic material systems which may be used for the conductor 120 can be found, for instance, in Table 2C of S. H. Fischer and M. C. Grubelich, "Theoretical energy release of thermites, intermetallics, combustible metals," in *Proc. 24th Int. Pyrotechnics Seminar*, (Monterey, Calif.), pp. 1-4, July 1998), herein incorporated by reference in its entirety. Other material systems may also be possible, including compounds of two different intermetallic systems such as titanium/boron and titanium/carbon in the form of titanium/boron carbide.

Constituent materials of the conductor may be provided whether mixed together or provided in discrete layers. For instance, the conductor 120 may be formed as one or more layers over the substrate 110 with the total thickness of the conductor 120 being about 1-50 μm. Thermite material systems such as aluminum (Al) and copper oxide (CuO) may be formed into self-sustaining, reactive foils in some embodiments. One major difference between thermite systems and intermetallic systems is that in a thermite reaction, the metal oxide component will typically have much lower thermal and electrical conductivity than the metal component. A challenge therefore is to design the detonator device so that sufficient heating will occur in both the metal and the metal oxide layers. For the metallic layers, it may be necessary to ensure sufficient electrical connectivity to each layer. Some elevated level of electrical energy to detonate the conductor 120 may be required for safety purposes, so that the energetic reaction is not initiated by stray electrical currents in some implementations.

The flyer layer 130 (which may also be referred to as a slapper layer) has an electrically non-conductive surface in contact with the conductor. When the conductor is exploded, one or more portions 130A of the flyer layer 130 may remain attached to the detonator structure while one or more plate portions 130B of the flyer layer 130 are configured to be explosively driven away from the detonator structure. As shown, the flyer layer 130 here is configured such that there is one primary plate portion 130B driven away from the detonator structure in a direction D. But it should be appreciated that other configurations and/or orientations of the flyer layer 130 are possible from what is shown.

For example, the plate portion(s) 130B of the flyer layer 130 may be designed to generate sufficient kinetic energy to initiate an insensitive energetic material (not shown) through shock, such as disclosed in U.S. Pat. Nos. 6,327,978 and 4,602,565, herein incorporated by reference in their entireties. For many insensitive materials, the threshold is typically in the range of about 10 kJ/g or higher. In some instances, plate portion(s) 130B of the flyer layer 130 may be explosively driven away from the conductor with acceleration on the order of about 100,000 times that of gravity, for instance. Thus, the plate portion(s) 130B may obtain supersonic velocities (e.g., 1-10 km/s) in less than about 100 ns (e.g., on the order of 10 s of nanoseconds). The flyer layer 130 might be about 1-200 μm in initial thickness, and can be formed of a non-conductive plastic or polymer materials. These may include polyp-xylylene) polymer (e.g., sold as Para Tech Coating Inc.'s Parylene®) or poly-oxydiphenylene-pyromellitimide polymer (e.g., sold as Dupont's Kapton®). In some embodiments, the flyer layer 130 can also be partly conductive, but any conducting material would need to be electrically isolated from the electrical conductor so that all current flows through the conductor. For instance, the plate might be composed of a metallic outer portions resulting in a flyer plate with more mass.

FIG. 1A also shows a schematic of a trigger circuit 140 used to detonate the detonator 100. When the sufficient electrical energy is supplied by voltage source V to the conductor 120, rapid heating and vaporization by the sufficient electrical energy of at least a portion of the conductor occurs so as to explosively drive a portion of the flyer layer away from the conductor. The sufficient electrical energy may be an electrical pulse having a power density of about 1-10 $W/\mu m^3$ which may be produced, for instance, by voltage and current values of 0.5-20 kV, and 0.1-100 kA, respectively, applied over about 10-1000 ns. These power inputs in certain embodiments should cause sufficiently rapid heating to melt, vaporize, and ionize the conductor 120 before it has a chance to physically move enough to break the circuit. The trigger circuit 140 can further include a switch which is configured to close rapidly in order to produce the desired current pulse and may need low inductance.

Use of reactive materials can maintain controllability of the reaction at lower input voltages and enables use of smaller electrical capacitors than in conventional EFIS and slappers. Thus, the same electrical capacitor(s) can be uses to drive additional detonators and potentially control timing and direction of the main charge detonation.

The detonator may be configured as a slapper detonator or an exploding foil EFI in some embodiments. The conductor 120 may be formed as a thin metal wire, strip, foil, bridge, or the like.

Figure 1B:
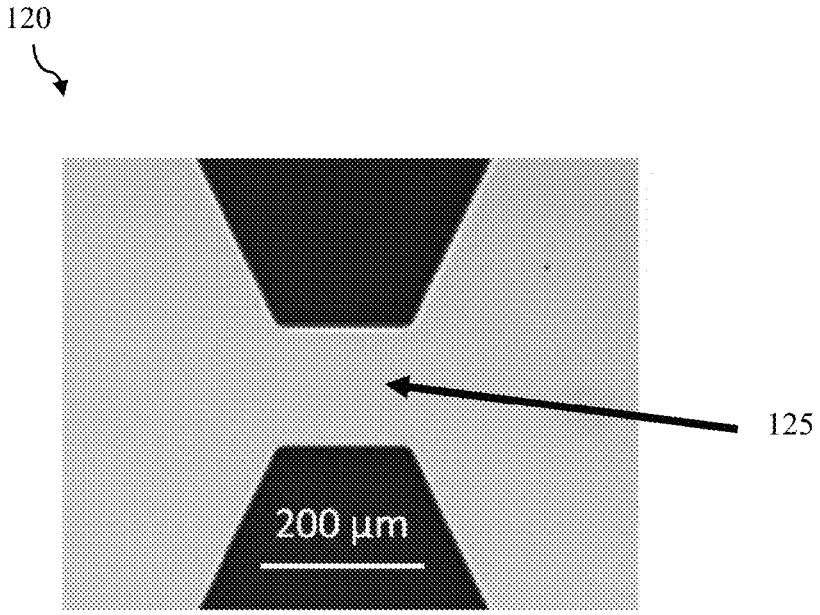
FIG. 1B is a photograph of a microscope image showing a conductor according to an embodiment.

FIG. 1B is a photograph of a microscope image showing a conductor 120 according to an embodiment. The conductor 120 here has been configured as a bridge structure having a narrowed portion 125. It has been patterned into a so-called "bow-tie" shape. In the narrowed portion 125, electrical resistance will be maximum or highest. Thus, when electrical current is delivered through the narrowed portion 125, the higher resistance region of the conductor here causes extremely rapid heating of the conductor 120 through its melting and boiling points, and the explosive expansion of conductor gases drives away a portion of the exploding plate.

Previously, it had been reported that reactive intermetallic materials systems composed of electrically conductive metal constituents (such as nickel and aluminum) which exothermically mix or otherwise can provide a 5-10% boost in efficiency of an exploding bridge wire device. See, e.g., Morris, C. J., Mary, B., Zakar, E., Barron, S., Fritz, G., Knio, O., Weihs, T. P., Hodgin, R., Wilkins, P., and May, C., "Rapid Initiation of Reactions in Al/Ni Multilayers with Nanoscale Layering," *J. Phys Chem Solids*, vol 71, no. 2, pp. 84-89 (2010), herein incorporated by reference in its entirety. Rapid heating of the conductor 120 through Joule-heating causes the reaction to occur much more quickly than it would normally do so under its own self-propagation rate.

Figure 2:
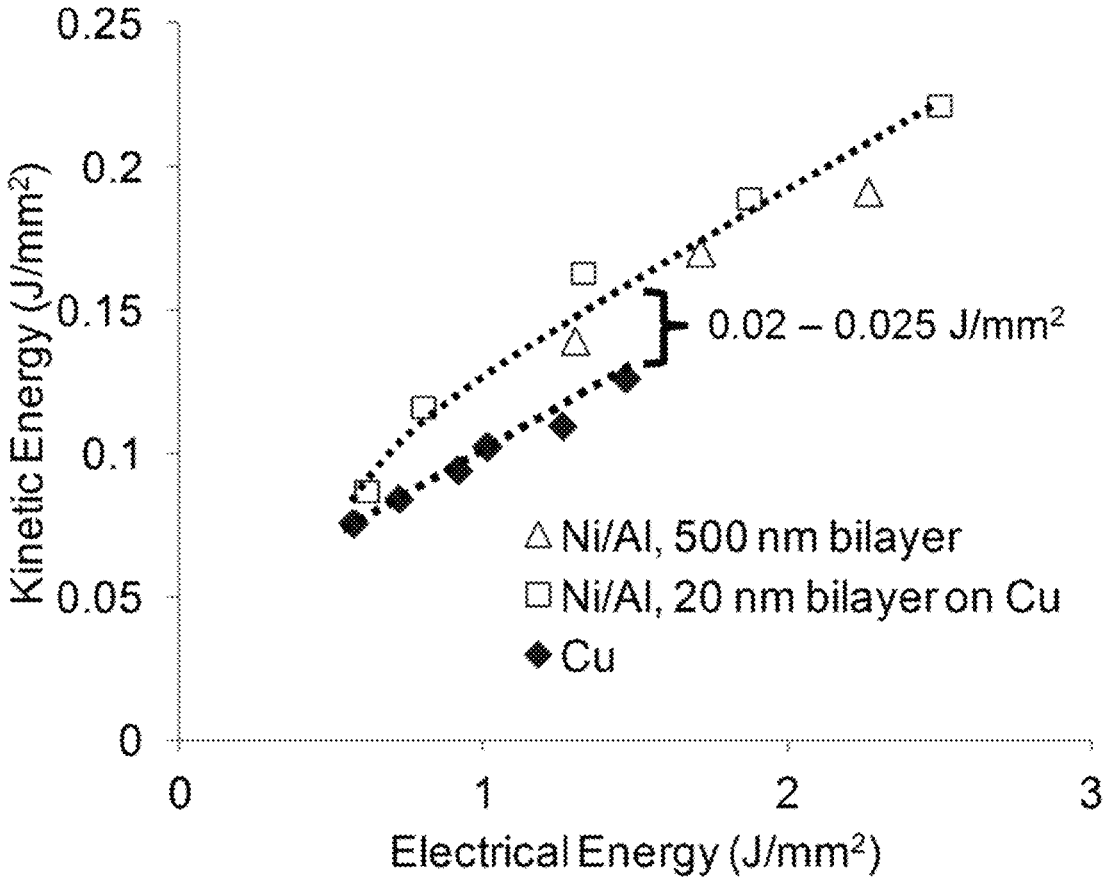
FIG. 2 shows a plot of Kinetic Energy vs. Electrical Energy on a per unit area basis for different specimens and film thicknesses tested.

FIG. 2 shows a plot of Kinetic Energy vs. Electrical Energy on a per unit area basis for different specimens and film thicknesses tested. The tested specimens include a 500 nm bilayer of nickel and aluminum, a 20 nm bilayer of nickel and aluminum formed of copper, and a layer of copper. This data shows that the reactive Ni/Al conductors contributed 0.02-0.025 $J/mm^2$ of additional kinetic energy, or up to about 10% of the total kinetic energy delivered by the flyer plate, when compared with non-reactive conductors composed merely of copper. Similar results were reported for non-reactive Ni and non-reactive Al.

The inventors also performed experiments using streak spectroscopy to better dynamically compare the reactive Ni/Al samples with their Al and Ni counterparts. See, e.g., C. J. Morris, P. Zakar, Eugene Wilkins, C. May, and T. P. Weihs, "Streak spectroscopy of reactive Al/Ni foil initiators," in *Proc. 27th Annual Army Science Conference*, (Orlando, Fla.), Nov. 30-Dec. 3, 2010, herein incorporated by reference in its entirety.

Figure 3:
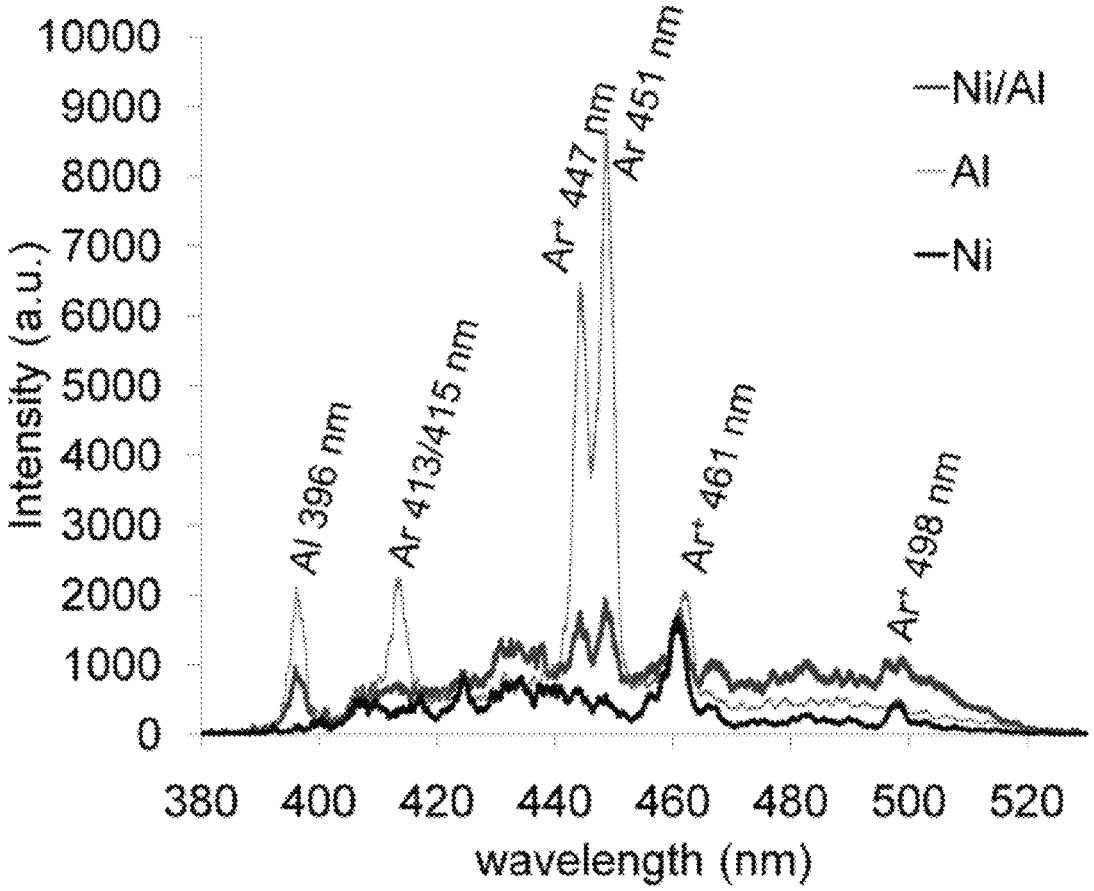
FIG. 3 illustrates a spectroscopic plot of sample emissions vs. wavelengths for various sample tested.

FIG. 3 illustrates a spectroscopic plot of sample emissions vs. wavelengths for various sample tested. The tested specimens included Ni/Al, Al, and Ni with sample emission at 100 ns following burst, over wavelengths of 380 to 520 nm. In the plot, major aluminum (Al) and argon (Ar) peaks are identified. Each sample tested exhibited both similar and distinct spectroscopic features. Both Al and Ni/Al samples produced peaks associated with atomic Al at 396 nm.

Figure 4:
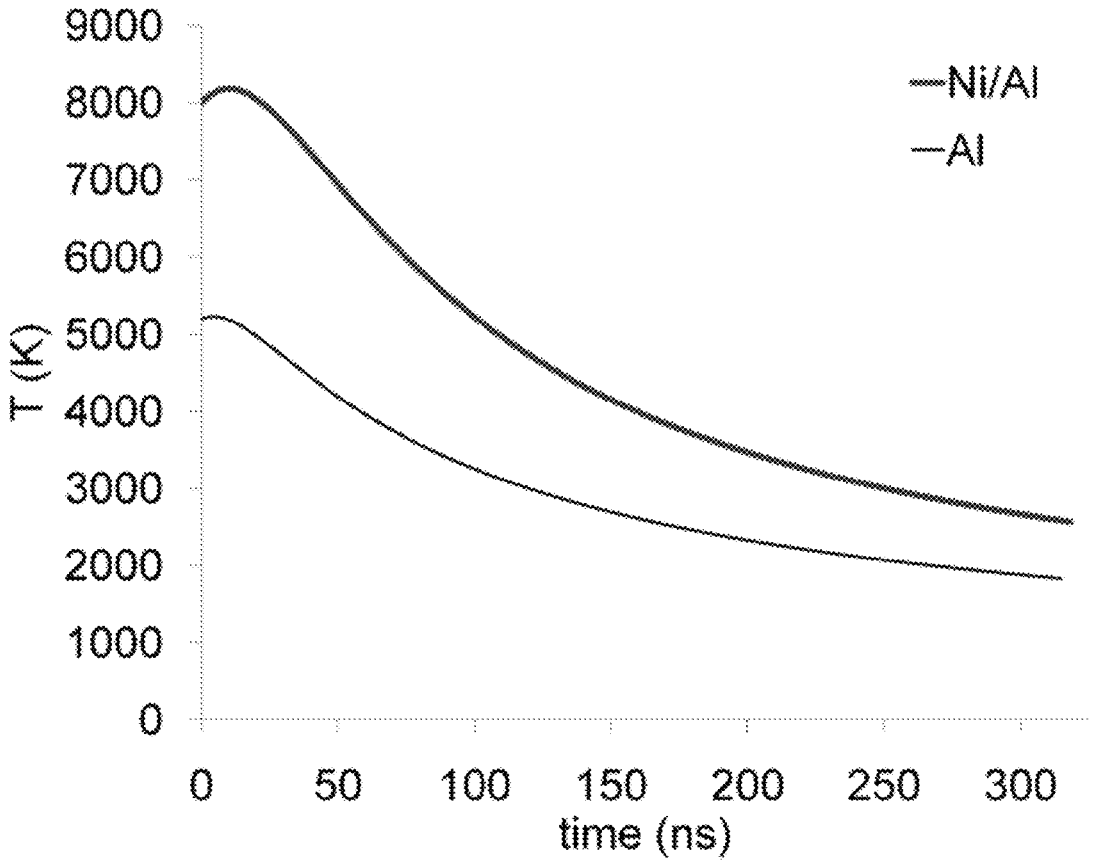
FIG. 4 shows a plot of predicted blackbody radiation for certain materials tested.

FIG. 4 shows a plot of predicted blackbody radiation for certain materials tested. The temperature vs. time predicted by blackbody radiation curve fits to Ni/Al and Al intensity vs. time curves at 487.5 and 530 nm. In addition, Weibull distribution fits were performed on each curve to smooth out random fluctuations. Broadband emissions were compared to expected blackbody radiation curves given by Plank's Law, to deduce the temperature values shown. The higher Ni/Al temperatures compared with Al validated measurements of increased kinetic energies.

These results are significant and quite unexpected, because the self-propagation rate along the length of a Ni/Al film is normally expected to be limited by heat diffusion along and between the reactive layers, and typically peaks at about 10 m/s. See, e.g., A. J. Gavens, D. V. Heerden, A. B. Mann, M. E. Reiss, and T. P. Weihs, "Effect of intermixing on self-propagating exothermic reactions in Al/Ni nanolaminate foils," *Journal of Applied Physics*, vol. 87, no. 3, pp. 1255-1263, 2000, herein incorporated by reference in its entirety. This self-propagation typically corresponds to a self-heating rate of $10^3$-$10^6$ K/s. However, by electrically forcing the entire multilayer stack to heat with a 50 ns electrical pulse, the patterned Ni/Al bridges heated at $10^{11}$-$10^{12}$ K/s and forced the reaction to occur at a much higher rate.

Based on the results and methods previously known and/or reported, the inventors had expected the same electrical forcing of thermally-limited reactions to work with intermetallic systems having at least two electrically conductive metal constituents. Table 1, below, shows theoretical energy densities of selected intermetallic systems having electrically conductive metal constituents. The Ni/Al system, as well as most intermetallic reactions, is characterized by a heat of reaction of 1.5 kJ/g or less. However, the specific kinetic energy of an exploding flyer plate in most EFI applications is in the range of 5-20 kJ/g, so the fraction contributed by a reactive intermetallic bridge typically is very small.

TABLE 1

Theoretical energy densities of selected intermetallic systems having electrically conductive metal constituents.

| Reaction type | Reaction | Heat of reaction (kJ/g) | Heat of reaction ($kJ/cm^3$) |
|---|---|---|---|
| Intermetallic | Al + Ni | 1.4 | 7.1 |
| | Al + Zr | 1.1 | 4.7 |
| | Si + Ti | 1.3 | 4.0 |

The inventors have further determined that markedly improved efficiency results may be realized using an even more reactive set of materials for the conductor in the detonator device. More particularly, it has been found that much more energy is available from energetic material systems having at least two constituents including (i) an electrically conductive constituent, and (ii) an electrically non-conductive constituent, that when subjected to sufficient electrical energy, result in an exothermic reaction. This may include thermite energetic material systems (i.e., a metal and a metal oxide) and certain intermetallic energetic material systems (i.e., including electrically conductive and electrically non-conductive metals), on either a per-mass or per-volume basis. Table 2, below, shows theoretical energy densities of selected thermite and intermetallic systems having at least an electrically conductive constituent, and an electrically non-conductive constituent.

TABLE 2

Theoretical energy densities of selected thermite and intermetallic systems having at least an electrically conductive constituent, and an electrically non-conductive constituent.

| Reaction type | Reaction | Heat of reaction (kJ/g) | Heat of reaction (kJ/cm$^3$) |
|---|---|---|---|
| Thermite | Al + CuO | 4.1 | 20.8 |
| | Al + $Fe_2O_3$ | 4.0 | 16.5 |
| | Mg + $MnO_2$ | 5.53 | 16.6 |
| Intermetallic | Be + 2C | 7.3 | 15.5 |
| | Mg + S | 6.27 | 12.8 |
| | 2B + Ti | 5.5 | 21.6 |
| | C + Ti | 3.1 | 11.5 |

The larger energy density of these energetic material systems is believed to make up 25-90% of the required kinetic energy level, resulting in a much lower required level of electrical input energy and a correspondingly more efficient device. This remarkable increase in kinetic energy most likely results from a higher temperature of electrically vaporized conductor materials. Electrically heating of these materials at six to nine orders of magnitude faster heating rates (than for nickel/aluminum intermetallic systems) may be realized.

Figure 5:
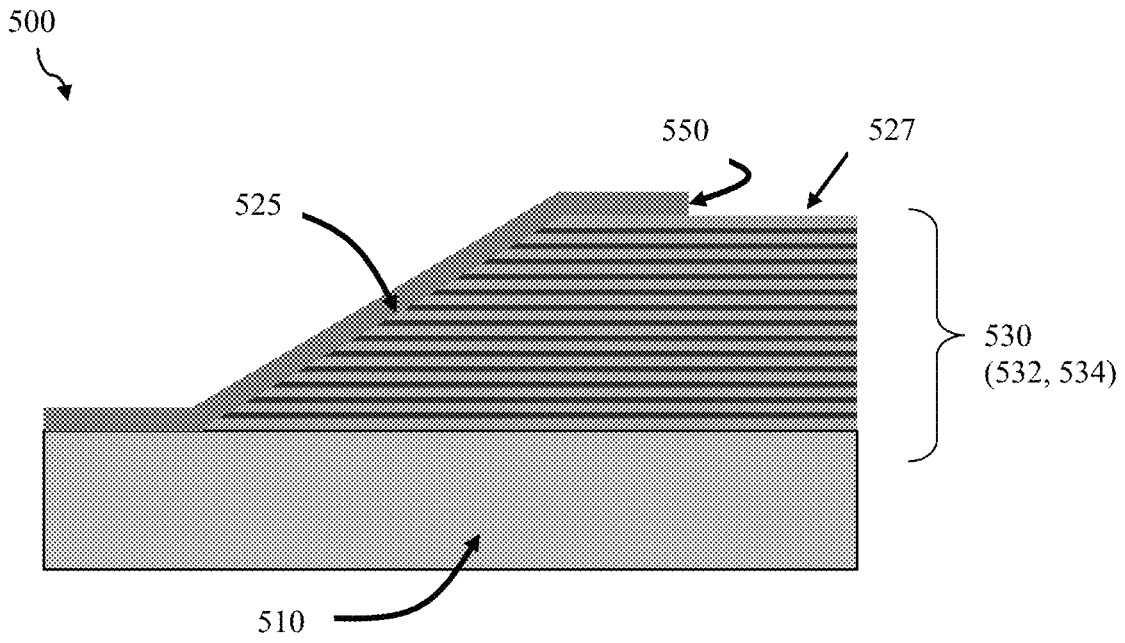
FIG. 5 illustrates a schematic showing detonator formed of a multilayer conductor according to an embodiment.

FIG. 5 illustrates a schematic showing detonator 500 formed of a multilayer conductor 520 according to an embodiment.

Formed on a substrate 510, the multilayer conductor 520 is formed as a stack of alternating layers including at least one of the electrically conductive layer 522 and at least one of the electrically non-conductive layer 524, although multiple layers of each type of layer are shown. The substrate 510 may be 0.5 mm or greater in thickness.

The multilayer conductor advantageously provides short diffusion paths between two constituents in a reactive material system, such that when rapidly heated through electrical joule heating, the two constituents rapidly mix and energy is released. The multilayer conductor also provides parallel conductor paths for at least one electrically conductive constituent, such that if another constituent is non-conductive, the overall conductor 520 remains conductive.

The number of alternating layers of the multilayer conductor 520 may vary from 5 to 200, for instance. More or less layers may be provided in other embodiments, although, the more layers provided may incrementally increase fabrication time. With the individual layer thickness of any electrically non-conductive layer 524 determined by equations 1-3 below, the number of layers can determine the total conductor thickness and therefore the total resistance.

The multilayer conductor 520 might be 1-50 μm thick, with each individual layer 522, 524 being about 10-200 nm thick in certain embodiments. The thickness of the electrically non-conductive layer 524 may be determined by the analysis described by equations 1-3 below. The alternating layers 522, 524 may be formed to be substantially parallel to a substrate 510 with edges of the alternating layers defining at least one sidewall 525 extending from a surface of substrate 510 on which the multilayered conductor 520 is formed.

The detonator 500 may also include an electrode 550 formed on at least a portion of the sidewall 525 that ensures electrical connectivity to each electrically conductive constituent layer in the multilayered stack. The electrode 550 might be 0.1-10 μm thick, for example. And the electrode 550 may be patterned and applied by a suitable deposition technique such as plating or sputtering, for example. The thicknesses of the electrode 550 may be judiciously sized to ensure that the at least one electrically non-conductive constituent layer 524 heats at approximately the same rate as the at least one electrically conductive constituent layer 522 in the multilayered stack. The thickness of each electrically conductive layer 522 can be determined as stoichiometrically needed. For example, in the case of a Ti+2B intermetallic system, each 50 nm layer of boron could be paired with 58 nm of titanium. The thickness values here may be determined from ratios of atomic masses and densities.

The sidewall 525 of the detonator may include a tapered surface that extends at an angle relative to the surface the substrate 510. In some embodiments, the tapered sidewall 525 may be formed by ion-milling or similar process. The tapered sidewall 525 may enable electrical connections to all the parallel, embedded electrical conductor layers 522 in the stack. But an electrode may provide similar results, that extends at substantially perpendicular, i.e., approximately 90 degrees from the surface the substrate 510. The electrode 550 generally conforms to sidewall. While not shown in FIG. 5, a flyer layer may be formed over the top surface 527 of the conductor 520 similar to the flyer layer 130 shown in FIG. 1A.

The sloped sidewall 525 may be formed using a combination of photoresist sidewall profiling and ion milling, for instance. When controlled, this process may be used to transfer a photoresist sidewall profile into an arbitrary stack of materials as discussed in E. Zakar, M. Dubey, B. Piekarski, J. Conrad, R. Piekarz, and R. Widuta, "Process and fabrication of a lead zirconate titanate thin film pressure sensor," *Journal of Vacuum Science & Technology A*, vol. 19, no. 1, pp. 345-348, 2001, herein incorporated by reference in its entirety.

The conductor and flyer layer in various detonator embodiments can be fabricated using photolithography and conventional micro-fabrication, for instance. The conductor layer(s) may be formed by a plasma sputter deposition apparatus. For conductors composed of metal/metal-oxide thermites, or metal/metal intermetallics, the layers may be fabricated using argon-assisted sputter deposition. The sputtering apparatus may include multiple targets, one each composed of the desired constituent material. In one fabrication embodiment, a plasma in an argon (Ar) atmosphere (pressure of 1-20 mTorr) with appropriate target and substrate potentials will cause Ar ions to dislodge atoms from the target which redeposit on the substrate surface. By switching from one target to the next, a multilayered structure can be built up at typical deposition rates of approximately 0.03-10 nm/s. For certain compound materials, such as a metal oxide, it is also possible to reactively sputter the metal target in an oxygen/argon atmosphere, resulting in a metal oxide depositing on the substrate.

Also, it may also be possible to evaporate the materials in a vacuum (e.g., less than about 5e-6 Torr), by switching between two sources in some fabrication embodiments. In a thermal or electron-beam heated evaporator, for instance, the contents of a crucible are heated, vaporize, and condense on the substrate. Therefore, integration with other electrical, electronic, or semiconducting devices is possible.

According to various embodiments, the thermal conductivity of the electrically non-conductive layers, and their specific thicknesses is judiciously designed to ensure that those layers to heat at approximately the same rate as the electrically forced conductive layers.

For this consideration the inventors modeled the one-dimensional transient thermal conduction of heat into single layer of lower conductivity material with thermal diffusivity $\alpha^2$:

$$\frac{\partial \bar{T}}{\partial \bar{t}} = \frac{\partial^2 \bar{T}}{\partial \bar{x}^2} \tag{1}$$

where $\bar{T}$ is subtracted from an initial temperature and scaled by $\Delta T$ such that $0 \leq \bar{T} \leq 1$, $\bar{x}$ is scaled by the layer half thickness a, and $\bar{t} = t\alpha^2/a^2$. For an initial condition of $\bar{T}(\bar{x},0)=1$, a boundary condition of $\bar{T}(0, \bar{t})=0$ (temperature at $\bar{x}=0$ drops to zero just as $\bar{t}>0$), and a Neumann boundary condition of $\partial\bar{T}/\partial\bar{x}=0$ at $\bar{x}=1$ of corresponding to a line of symmetry at the layer half-thickness, the solution to equation (1) is $$\bar{T}(\bar{x}, \bar{t}) = \sum_{n=1}^{\infty} \frac{4}{(2n-1)\pi} e^{-\frac{(2n-1)^2\pi^2}{4}\bar{t}} \sin\left(\frac{(2n-1)\pi\bar{x}}{2}\right) \tag{2}$$

This equation predicts a temperature which initially starts out at one everywhere except $\bar{x}=0$, and then which drops to zero everywhere after some time. However, the subtraction of equation (2) from one is mathematically identical, $$\bar{T}(\bar{x}, \bar{t}) = 1 - \sum_{n=1}^{\infty} \frac{4}{(2n-1)\pi} e^{-\frac{(2n-1)^2\pi^2}{4}\bar{t}} \sin\left(\frac{(2n-1)\pi\bar{x}}{2}\right) \tag{3}$$

because $\bar{T}$ only appears in equation (1) as a derivative. Equation (3) more closely represents our case of a temperature initially at zero everywhere except at $\bar{x}=0$ (where $\bar{T}=1$), and which then rises to one everywhere.

Figure 6:
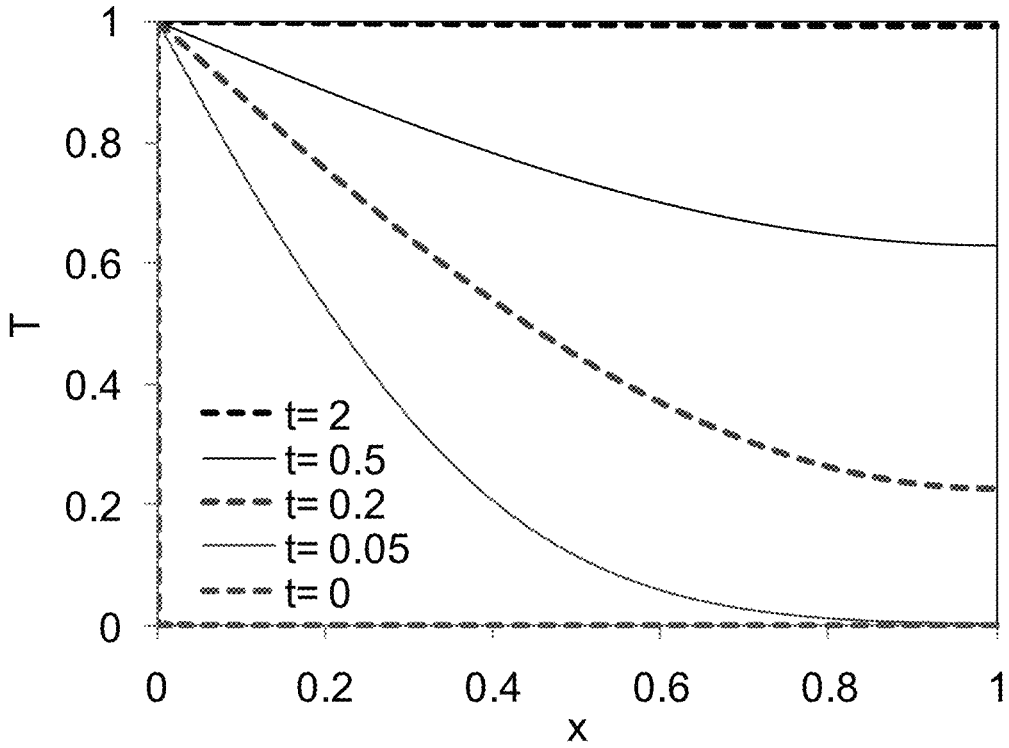
FIG. 6 shows temperatures predicted by equation (3).

FIG. 6 shows temperatures predicted by equation (3), indicating that the entire slab is at 99% of the final temperature after a non-dimensional time value of 2.0. The temperatures were calculated as solutions to equation (3) at various non-dimensional times, showing a non-dimensional temperature T which starts out at zero everywhere except at x=0 (where T=1), and which then rises after some time to T=1.

Relating this value back to a real time, for a layer half-thickness of 10 nm, and thermal diffusivity of 1790 $nm^2/ns$ (corresponding to CuO), the layer will be at 99% of the boundary temperature after 0.11 ns. For a layer half-thickness of 50 nm, this temperature should be reached after about 2.79 ns. As long as this time is much less than the timescale over which electrical heating occurs, the temperature in the less thermally conductive layer will lag the temperature in the electrically heated layer by a negligible amount.

The foregoing embodiments enable more efficient EFI and slapper detonator devices which are used to rapidly convert energy from an electrical power pulse through a conductor to kinetic energy of a flyer plate. Testing has demonstrated effective efficiency increases of around 10% using reactive Ni/Al, and increases of more than 50% with other reactive material systems described herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, to thereby enable others skilled in the art to best utilize the invention and various embodiments with various modifications as may be suited to the particular use contemplated.

Various elements, devices, modules and circuits are described above in associated with their respective functions. These elements, devices, modules and circuits are considered means for performing their respective functions as described herein.

While the foregoing is directed to embodiments of the present invention, other and further embodiments of the invention may be devised without departing from the basic scope thereof, and the scope thereof is determined by the claims that follow.

What we claim is:

1. A detonator comprising:

a substrate composed of electrical insulator material;

a conductor disposed on the substrate including at least two constituents including (i) an electrically conductive constituent, and (ii) an electrically non-conductive constituent, that when subjected to sufficient electrical energy, result in an exothermic reaction; and a flyer plate having a non-conductive surface in contact with said conductor, wherein, the detonator is configured so that when the sufficient electrical energy is supplied to said conductor, rapid heating and vaporization of at least a portion of the conductor alone occurs so as to explosively drive at least a portion of the flyer plate away from said conductor.

2. The detonator of claim 1, wherein the exothermic reaction of the at least two constituents is a chemical reaction, a physical reaction, or some combination thereof.

3. The detonator of claim 1, wherein the electrically conductive constituent and the electrically non-conductive constituent comprise a metal and a metal oxide, respectively, of a thermite material system.

4. The detonator of claim 1, wherein the electrically conductive constituent and the electrically non-conductive constituent comprise an electrically conductive metal and an electrically non-conductive metal, respectively, of an intermetallic material system.

5. The detonator of claim 1, wherein the conductor includes a narrowed portion where electrical resistance of the conductor is maximum.

6. The detonator of claim 1, where the conductor comprises a multilayered stack formed of alternating layers of at least one layer of the electrically conductive constituent, and at least one layer of the electrically non-conductive constituent, the alternating layers being substantially parallel to a substrate with edges of the alternating layers defining a sidewall.

7. The detonator of claim 6, further comprising an electrode formed on at least a portion of the sidewall that ensures electrical connectivity to each electrically conductive constituent layer in the multilayered stack.

8. The detonator of claim 6, wherein the sidewall extends at an angle relative to the surface the substrate.

9. The detonator of claim 6, wherein the sidewall extends at approximately 90 degrees from the surface the substrate.

10. The detonator of claim 1, wherein the sufficient electrical energy comprises an electrical pulse having a power density of about 1-10 W/$\mu m^3$.

11. The detonator of claim 1, wherein the portion of the flyer plate explosively driven from the conductor is accelerated on the order of about 100,000 times that of gravity.

12. The detonator of claim 1 being configured as a slapper detonator or an exploding foil initiator (EFI).

13. The detonator of claim 1, with the total thickness of the conductor is about 1-50 μm to explosively drive away the flyer plate away from said conductor.

14. The detonator of claim 1, wherein the detonator does not include energetic material which is to be ignited to drive away the flyer plate away from the conductor.

15. A detonator comprising:

a substrate composed of electrical insulator material;

a multilayer conductor disposed on the substrate formed of alternating layers of at least one electrically conductive layer, and at least one electrically non-conductive layer, that when subjected to sufficient electrical energy, result in an exothermic reaction, the alternating layers being substantially parallel with edges of the alternating layers defining a sidewall;

an electrode formed on at least a portion of the sidewall that ensures electrical connectivity to each electrically conductive layer of the conductor; and an exploding plate having a non-conductive surface in contact with said conductor, wherein, the detonator is configured so that when the sufficient electrical energy is supplied to said conductor, rapid heating and vaporization of at least a portion of the conductor alone occurs so as to explosively drive at least a portion of the plate away from said conductor.

16. The detonator of claim 15, wherein the number of alternating layers ranges from 5 to 200.

17. The detonator of claim 15, wherein the exothermic reaction of the at least two constituents is a chemical reaction, a physical reaction, or some combination thereof.

18. The detonator of claim 15, wherein the thicknesses of at least one of the electrically non-conductive layer is sized to ensure that the at least one electrically non-conductive layer heats at approximately the same rate as the at least one electrically conductive layer.

19. The detonator of claim 15, wherein the sidewall extends at an angle relative to the surface the substrate.

20. The detonator of claim 15, wherein the sidewall extends at approximately 90 degrees from the surface the substrate.

21. The detonator of claim 15, further comprising an electrode formed on at least a portion of the sidewall that ensures electrical connectivity to each electrically conductive constituent layer in the multilayered stack.

22. The detonator of claim 15 being configured as a slapper detonator or an exploding foil initiator (EFI).

* * * * *